United States Patent [19]

Wakamatsu

[11] 4,300,185

[45] Nov. 10, 1981

[54] LIGHT FIXTURE UNIT FOR OPEN PLAN OFFICE

[75] Inventor: Jack K. Wakamatsu, Los Angeles, Calif.

[73] Assignee: C. W. Cole & Company, Inc., South El Monte, Calif.

[21] Appl. No.: 101,224

[22] Filed: Dec. 7, 1979

[51] Int. Cl.[3] ..... A61G 13/00

[52] U.S. Cl. ..... 362/33; 362/223; 362/225; 362/308; 362/147; 362/309

[58] Field of Search ..... 362/33, 223, 225, 147, 362/308, 309

[56] References Cited

U.S. PATENT DOCUMENTS 4,204,274 5/1980 Lüderitz ..... 362/240 X

*Primary Examiner*—Stephen J. Lechert, Jr.

*Attorney, Agent, or Firm*—John T. Matlago

[57] ABSTRACT

A light fixture unit is provided for use at a work station of an open plan office design. The light fixture unit combines in a single framework a downwardly facing light chamber for directing light onto a task work surface and an upwardly facing light chamber for directing light over a wide area for reflection off the ceiling of the office area to provide ambient indirect light.

9 Claims, 9 Drawing Figures

LIGHT FIXTURE UNIT FOR OPEN PLAN OFFICE

BACKGROUND AND SUMMARY OF THE INVENTION

This invention relates to light fixtures and more particularly to a light fixture unit especially adapted for use at a work station in an open plan office.

In an open plan office, the work stations are defined by easily arranged free standing partitions or panels together with modular cabinets and work surfaces. This is of great assistance in readily rearranging a portion of the office in a company as needed from time-to-time to adapt to new products.

One of the problems encountered by rearranging the work stations in an open plan office in this manner is that the fixed ceiling lights conventionally provided in an office area require a compromise in the locations of the work stations. It is thus seen that it would be of great advantage to be able to replace the fixed ceiling light with an individual light fixture unit at each of the work stations. Each light fixture unit provides not only for lighting up the general area but also for effectively directing light onto the work surface located at the work station. Such a light fixture unit, because of its ability to be optimumly positioned to efficiently provide quality light at each work station enables less total wattage of lamps to be used. This, in turn, cuts down the heat emitted from the lamps and saves on the amount of air conditioning needed in the office area.

Briefly, the light fixture unit of the present invention comprises a rectangular housing having a downwardly facing light chamber formed in the front portion thereof for directing light onto a task work surface and an upwardly facing chamber in the rear portion thereof for spreading light upwardly over a wide area of the ceiling from which the light is reflected to provide an indirect light for the area.

Accordingly, the primary object of the present invention is to provide a light fixture unit especially adapted for use at a work station in an open plan office design.

Another object of the present invention is to provide a light fixture unit for a work station which efficiently combines in a single housing both a light chamber for directing light onto a task work surface and a light chamber for providing indirect ambient lighting about the work station.

Still another object of the present invention is to provide a light fixture unit for a work station in an open office which can be easily arranged along with the partitions and the modular furniture therefor.

With these and other objects in view, the invention consists of the construction, arrangement, and combination of the various parts of the device, whereby the objects contemplated are attained, as hereinafter set forth, pointed out in the appended claims and illustrated in the accompanying drawings.

DETAILED DESCRIPTION OF PREFERRED EMBODIMENT

Figure 2:
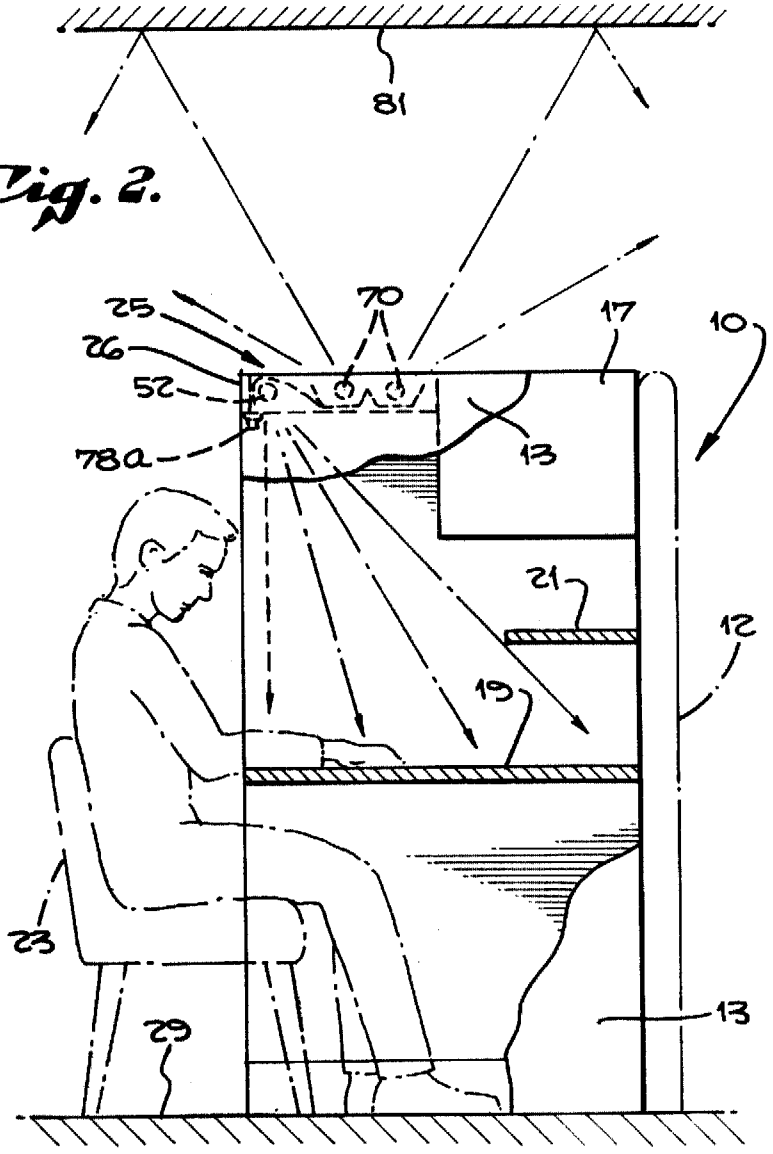
FIG. 2 is a side view of the work station of FIG. 1 as taken generally along line 2—2 of FIG. 1.
Figure 1:
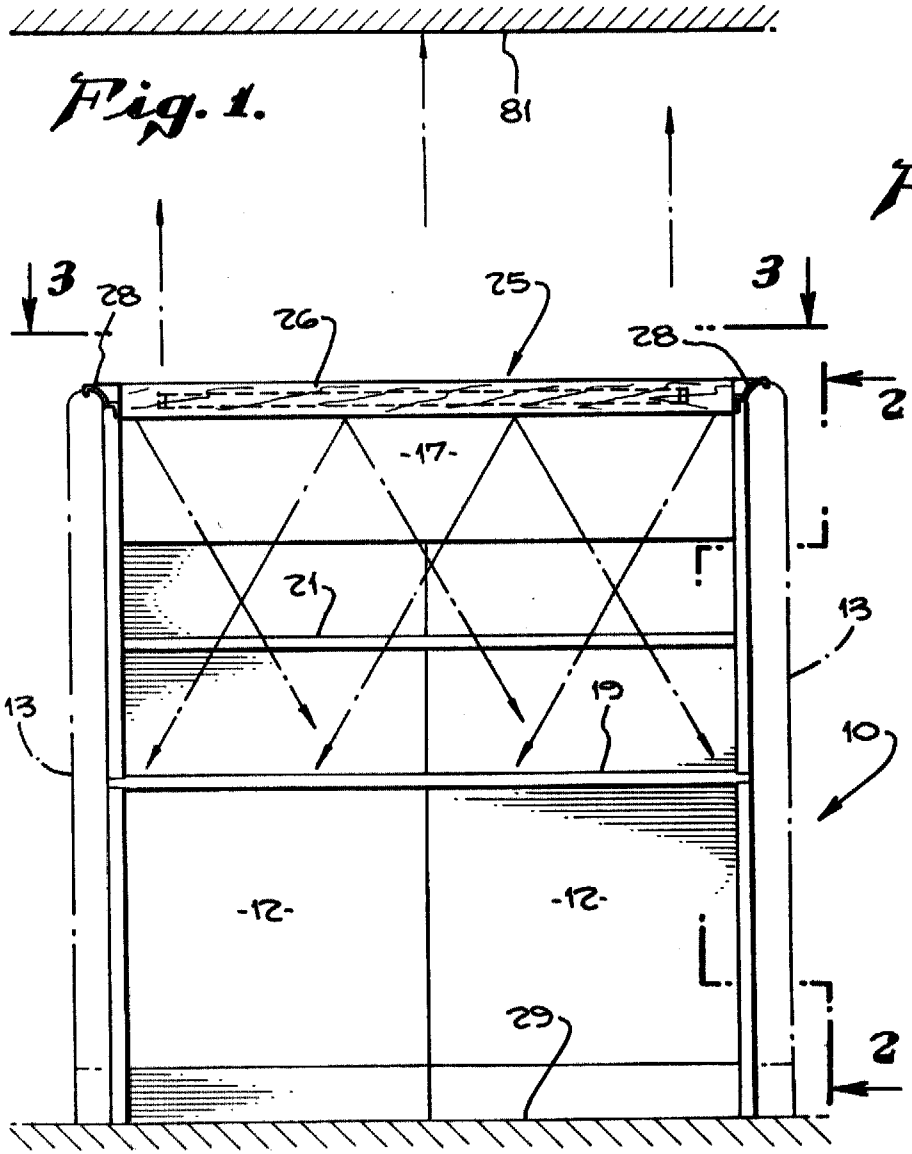
FIG. 1 is a front view of an open plan office work station with the light fixture unit of the present invention mounted for use therewith.

Referring to FIGS. 1 and 2 of the drawings, a typical work station 10 in an open plan office is shown to comprise a back wall formed by joining two aligned rear panels 12 and opposing side walls formed by joining side panels 13 by use of corner members (not shown) to the outer ends of the rear panels. The panels, which are all free standing, are each typically 60 inches in height and 30 inches in width. A cabinet 17 is attached by the use of clips to the rear panels 12 and a table or horizontal task work surface is attached by the use of clips to the side panels 13 approximately 28 inches above the level of the floor 29. The clips used for mounting the cabinet 17 and the task work surface 19 to the walls of the work station are of the conventional type.

The cabinet 17 extends forwardly from the back panels about one-half the width of a side panel 13 while the task work surface 19 extends forwardly the full width of the side panels 13. The work surface 19 is thus 30 inches deep and 60 inches long. A shelf 21 which is approximately one-third the width of the side panels 13 may be mounted in a similar manner by the use of clips on the back panels at a level intermediate to the bottom of the cabinet 17 and the task work surface 19.

The office worker assigned to the work station 10, when in his normal working position, sits on a chair 23, as illustrated in phantom lines, in front of the task work surface 19

The light fixture unit 25 of the present invention having a wood facia 26 on the front thereof is mounted by a pair of hangers 28 on each end thereof across the side panels 13 of the work station 10. When so mounted the back of the light fixture unit 25 abuts up against the front of the cabinet 17 and the front of the light fixture unit 25 is positioned over the front edge of the work surface 19. The floor 29 of the open area is provided with ducts and/or a plurality of electrical outlets (not shown) thereabouts which permit electrical lines and telephone cables to be run along the base and sides of the panels for use at each of the work stations.

Referring next to FIGS. 3 to 9 of the drawings, the light fixture unit 25 of the present invention is shown to include a rectangular framework or housing 30 comprised of front and rear longitudinal walls **32*a* and 32*b* formed of lengths of an aluminum extrusion and end walls 33*a* and 33*b* formed of aluminum plates. The end walls 33*a* and 33*b* are attached to the ends of the front and rear walls 32*a* and 32*b* by screws 35 engaging screw ways 37** extruded thereon.

The interior of the rectangulr framework 30 is divided by a longitudinally extending aluminum sheet member 36 which is shaped by bending to form a downwardly facing task light chamber 38 along the front portion thereof and an upwardly facing ambient light chamber 39 along the rear portion thereof. The sheet member 36 thus includes an intermediate angular wall portion 40 which divides the two chambers, an upper horizontal wall portion 41 which forms the top wall of the task light chamber 38, and a lower horizontal wall portion 58 which forms the bottom wall of the ambient light chamber 39.

The sheet member 36 is held within framework 30 by inserting the front upper side edge thereof into a slot 34*a* extruded near the top of the front wall 32*a* and by inserting the rear lower side edge thereof into a slot 34*b* extruded near the bottom of the rear wall 32*b*. It should be noted that the front and rear longitudinal walls 32*a* and 32*b* are made of the same aluminum extrusion with one inverted with respect to the other. Corner braces 43 (FIG. 6) provide for attaching the upper and lower horizontal wall portions 41 and 58 of member 36 to the end walls 33*a* and 33*b*.

Mounted so as to extend longitudinally within the task light chamber 38 is a specular reflector 45. The reflector 45 has a front vertical portion 47 which is attached by a plurality of spaced screws 48 engaging a screw way 50*a* integrally formed on the inner side of the extruded front wall 32*a*. The top of the reflector 45 extends over a longitudinally extending fluorescent lamp 52 mounted on lamp holders 53 attached on the ends thereof and then extends rearwardly and downwardly with preferably a portion of a parabolic shaped surface 59. The lower end of the reflector 45 engages in the corner of an angularly shaped member 55 having one leg thereof spot welded to the lower portion of the angular wall portion 40 of member 36. A linear prismatic control lens 56 which covers the bottom of the task light chamber 38 has one side edge thereof resting on the horizontal leg of the support member 55 and the other side edge thereof attached by screws 57 to an offset lip 44*a* formed on the lower end of the extruded front wall 32*a*.

Figure 7:
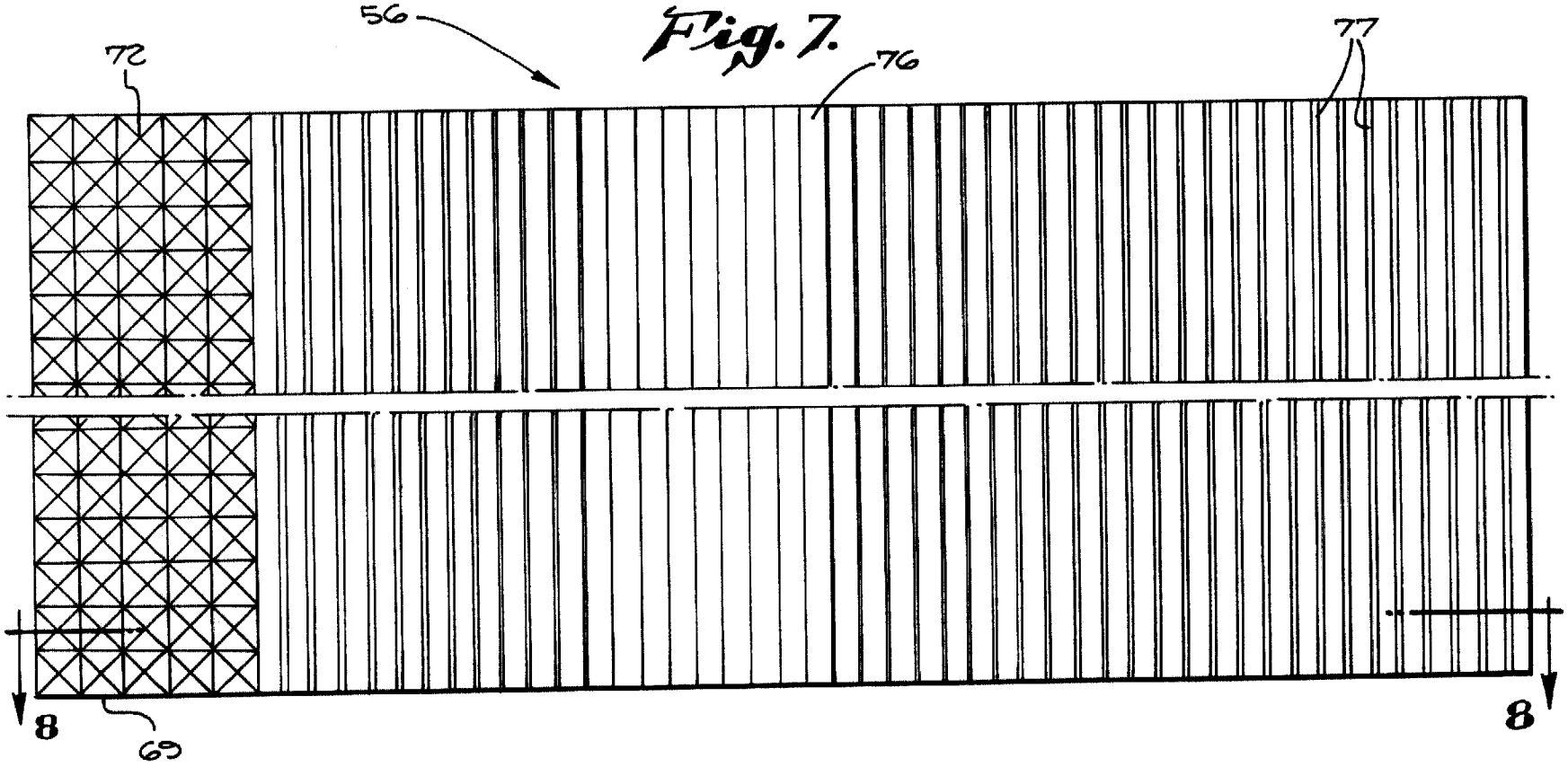
FIG. 7 is an enlarged partial plan view of the task light chamber control lens as taken along line 7—7 of FIG. 4.
Figure 8:
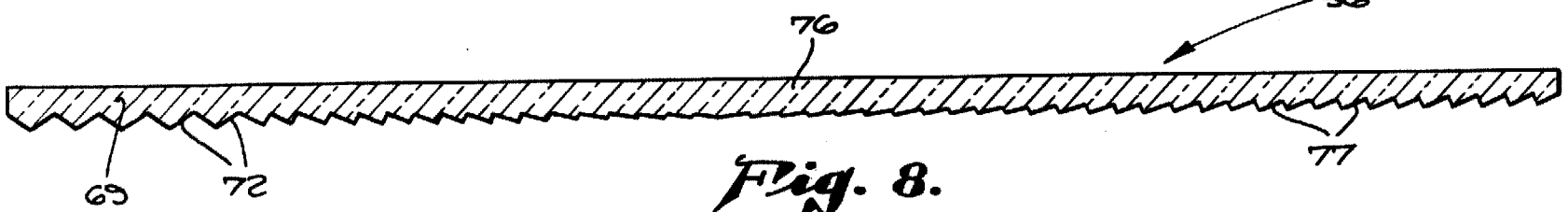
FIG. 8 is a sectional view of the task light chamber control lens as taken along line 8—8 of FIG. 7.

As shown in FIGS. 7 and 8, the linear prismatic control lens 56 which is made of acrylic plastic has a marginal longitudinally extending strip portion 69 along the front thereof which is formed with rows and columns of pyramidal indentations 72 having prismatic shaped sides. The remaining portion 76 of the control lens 56 is formed with a plurality of longitudinally extending linear indentations 77, each indentation forming a sawtooth-like structure.

As shown in FIG. 8, the depth of each successive linear indentation 77 on portion 76 of the control lens 56, starting on the front thereof adjacent strip portion 69, gradually decreases for a short distance until it is almost absent. Thereafter, the depth of each successive linear indentation 77 gradually increases toward the opposite or rear end of the portion 76. Utilizing the linear prismatic control lens constructed in this manner is of great assistance, along with the reflector 45, in controlling the bending of the light rays emitted from the task light chamber 38 such that they more evenly strike the work surface 19 so as to produce the desired illumination effect.

The ambient light chamber 39 includes an upwardly facing channel specular reflector 61. Reflector 61 has one flat angular side 62 thereof resting against the flat angular wall portion 40 of the member 36 and the other flat angular side 63 thereof provided with an upper horizontal extension 64 by which it is supported on the upper offset lip 44*b* formed on the extruded rear wall 32*b*.

The bottom 67 of reflector 61 is provided along the length thereof with a plurality of spaced dimples 66 which are slit to engage the side edges of a longitudinally extending inverted V shaped specular reflector 68 located midway between a pair of longitudinally extending spaced fluorescent lamps 70. Lamps 70 are mounted on lamp holders 71 attached on the ends of the channel reflector 61.

Two or more ballasts 73 for operating the task lamp 52 and the ambient lamps 70 are mounted within the framework 30 on the rear wall 32*b* thereof by screws 74 engaging in the screw way 50*b* extruded on the back wall 32*b*.

A longitudinally extending radial batwing diffuser lens 75 covers the top of ambient light chamber 39. One side edge of the diffuser lens 75 rests on a horizontal lip 65 formed on the upper end of the angular side 62 of the reflector 61 and the other side edge thereof rests on the upper horizontal extension 64 of reflector 61 which is supported in the extruded notch 44*b* of the back wall 32*b*.

Figures 3, 4, 5, 6, 9:
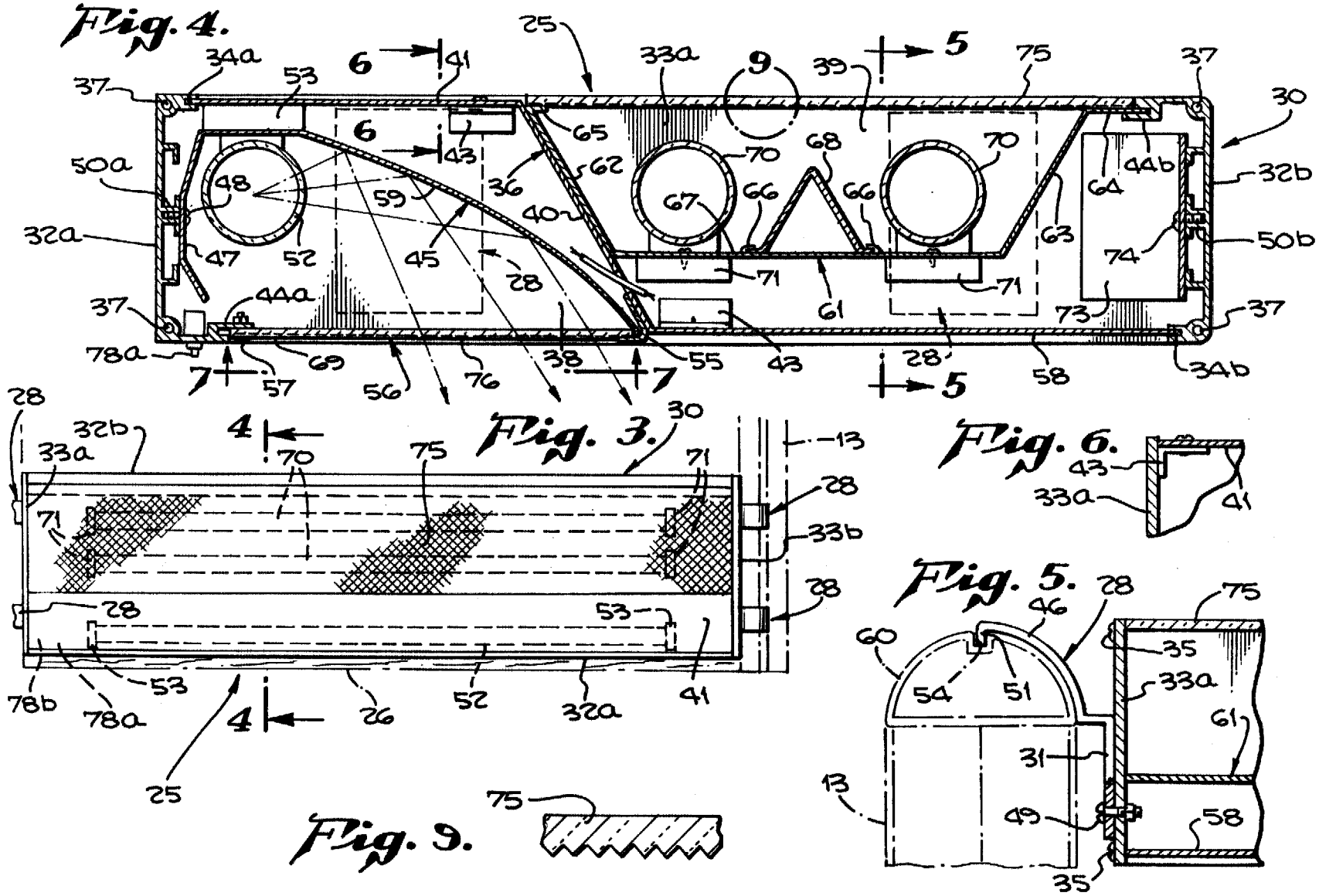
FIG. 3 is a partial top view of the work station showing the light fixture unit mounted thereon as taken along line 3—3 of FIG. 1.
FIG. 4 is a cross sectional view of the light fixture unit as taken along line 4—4 of FIG. 3.
FIG. 5 is a sectional view showing one of the end hangers for the light fixture unit as taken along line 5—5 of FIG. 4.
FIG. 6 is a fragmentary view as taken along line 6—6 of FIG. 4.
FIG. 9 is an enlarged fragmentary sectional view of the ambient light chamber diffuser lens shown in FIG. 4.

As shown in FIG. 9, the radial batwing diffuser lens 75 which is made of acrylic plastic is being used in the present light fixture unit 25 in an upside down position orientation, as compared to its conventional usage, in that the identations thereof are provided on the inner or lower surface of the lens 75. The reason for using the radial batwing diffuser lens 75 in this manner is to emphasize the outwardly bending of the light rays of the ambient lamps 70 upon passing therethrough so as to provide a more widespread dispersing of the light rays.

Two push button switches 78*a* and 78*b* are located near the bottom front of the light fixture unit 25. One push button switch 78*a* is provided for controlling the task fluorescent lamp 52 and the other push button switch 78*b* is provided for controlling the pair of fluorescent lamps 70.

As previously described, the light fixture unit 25 is provided with a pair of hangers 28 on each of the end walls 33*a* and 33*b* thereof. As illustrated in FIG. 5, each hanger 28 has a lower support portion 31 which is attached by screws 49 to the end walls 33*a* and 33*b* and a hook portion 46 having a vertical free end 51 which engages in a slot 54 provided along the top of the cap 60 of the side panel 13 of the work station 10.

By use of the hangers 28 the light fixture unit 25 is easily removably mounted at a work station between the two free standing side panels 13 so as to be positioned over the work surface 19. When so positioned, as shown in FIG. 2, the rear of the light fixture unit 25 abuts up against the front of the overhead cabinet 17, and the front of the light fixture unit 25, which may have a wood facia 26 attached thereto, is aligned with the front edge of the work surface 19.

As illustrated in FIGS. 2 and 4, the light emitted by the task light fluorescent lamp 52 is reflected off various points of the parabolic reflector surface 59 so as to spread out and, with the help of the linear prismatic control lens 56, tend to evenly illuminate the entire work surface 19.

It should be particularly noted that the front of the task light chamber 38 is positioned flush with the front of the work surface 19. Consequently, the task lamp 52 is substantially positioned over the front edge of the work surface 19 so as to minimize veiling or reflected glare effects thereon when viewed by the office worker sitting on the chair 23 in its normal position in front of the work surface 19. The pyramidal indentations 72 along the marginal longitudinal strip portion 69 of the control lens 56 aid in this respect in that they serve to disperse the rays of light directed downward from the task lamp 52 such that they do not create glare or veiling effects on the front edge portion of the work surface 19. Such a longitudinal strip portion 69 also assures that an image of the task lamp 52 will not be formed on the work surface 19 by the direct radiation therefrom.

It should now be appreciated that the task light chamber 38 is designed such that the light rays upon passing downwardly through the linear prismatic control lens 56 tend to be effectively and evenly distributed and concentrated over the relatively small area or confined space of the work surface 19 without providing any significant ambient or general surrounding light. On the other hand, the ambient light chamber 39 is designed such that the light rays upon passing upwardly through the radial batwing diffuser lens 75 effectively and evenly spread and reflect off a wide area of the ceiling 81 without creating any hot spot effects thereon and so as to tend to evenly light up the ambient space of the work station 10 with indirect light. Such an arrangement reduces the amount of electrical power for lighting needed in an office space to one-half to one-third that provided with conventional overhead or ceiling lights, and consequently also reduces the need for air conditioning power by a significant amount.

It should now be clearly understood that the light fixture unit 25 of the present invention is a direct approach to the solution of the difficult illumination problem for open plan office arrangements in that it effectively combines the task lighting and the ambient lighting in a single housing or unit. Thus, the light fixture unit 25 can be considered in the same manner as any other piece of furniture and thereby easily repositioned when a work station is to be rearranged in an open plan office design.

With the use of the linear prismatic control lens 56, the specular curved reflector 45, and the proper positioning of the fluorescent lamp 52 in relation to the work surface 19, the task light chamber 38 provides a highly efficient and balanced illumination over the work surface. Furthermore, the veiling effects on the work surface 19 are practically nonexistent when viewed from the normal working position. With the use of the radial batwing diffuser lens 75, the ambient light chamber 39 provides a very wide ambient up-light distribution or spread for an even ceiling illumination and its fixture efficiency is over 55 percent. Such a high output efficiency with very wide distribution ensures the providing of an ideal even overhead illumination without ceiling hot spot effects.

Thus, by use of the light fixture unit 25 of the present invention, with one 40 watt fluorescent lamp 52 in the task light chamber 38 and with a pair of 40 watt fluorescent lamps 70 in the ambient light chamber 39, for example, the work surface 19 can be maintained with an average illumination level of 80 foot-candles and an average Equivalent Sphere Illumination (ESI) level of 48 foot-candles while the general office area can be maintained with an average illumination level of 10 to 15 foot-candles.

The ratio of light provided in this manner at the work surface 19 of work station 10 is approximately five times the ambient light, i.e., the indirect illumination, provided in the general area around the work station. Such a ratio is well within the range of what is considered to be an ideal overall contrast ratio for an office environment. Moreover, the lighting system of the present invention enables an open plan office arrangement to adhere to the energy conservation requirements of 2 watts per square foot of office space or less.

While the description has been concerned with a particular structural embodiment of the present invention, it is to be understood that many modifications and variations in the construction and arrangement may be provided for without departing from the spirit and scope of the invention or sacrificing any of its advantages. The invention is therefore considered as including all such possible modifications and variations coming within the legitimate and valid scope of the appended claims.

I claim:

1. A lighting arrangement for a work station in an open plan office, the combination comprising:

a horizontal work surface;

an elongated light fixture supported above said work surface at a height higher than the eye height of a person seated adjacent the front edge of the work surface but not at a height substantially higher than the eye height of a person standing adjacent thereto;

said light fixture including an elongated light source having a longitudinal axis located substantially directly above and aligned with the front edge of the work surface; and said light fixture including a reflector and a control lens for directing the light from said light source over the work surface downwardly and rearwardly of the front edge thereof thereby preventing the formation of veiling reflections from the work surface towards a person seated adjacent the front edge of the work surface and facing to view a task thereon.

2. A lighting arrangement for a work station in an open plan office, the combination comprising:

a horizontally disposed work surface;

an elongated light fixture supported above said work surface at a height higher than the eye height of a person seated adjacent the front edge of the work surface but not at a height substantially higher than the eye height of a person standing adjacent thereto;

said light fixture including a downwardly facing task light chamber having mounted therein an elongated light source and an elongated reflector, and having mounted on the bottom thereof an elongated refractor plate;

said light source having a horizontal axis located near the front end of said elongated reflector and extending parallel to and substantially directly above the front edge of the work surface;

said refractor plate having formed on one of the surfaces thereof linear prismatic elements oriented parallel to the horizontal axis of said light source; and said reflector providing for reflecting light from the light source downwardly and rearwardly over the surface of the refractor plate such that the linear prismatic elements thereon redirect and distribute the light rays over the work surface such that they reflect therefrom in a direction away from a person seated adjacent the front edge thereof to view a task thereon.

3. A lighting arrangement for a work station in an open plan office as defined in claim 2 wherein said refractor plate includes a diffusing portion along the front longitudinal edge portion thereof disposed below the light source.

4. A lighting arrangement for a work station in an open plan office as defined in claim 3 wherein the depths of said linear prismatic elements starting adjacent said diffusing portion gradually decrease until they are almost absent and then gradually increase toward the rear end thereof.

5. A lighting arrangement for a work station in an open plan office as defined in claim 2 wherein said light fixture includes a baffle means on the front end thereof for preventing light emitted from said light source from being directed downwardly along a path at an angle toward the front of a vertical plane extending substantially through the horizontal axis thereof.

6. A lighting arrangement for a work station in an open plan office as defined in claim 2 wherein said light fixture includes a rectangular frame and said frame is mounted with its front wall substantially flush with the front edge of the work surface.

7. A lighting arrangement for a work surface in an open plan office as defined in claim 2 wherein said light fixture further includes on the rear half portion thereof an upwardly facing ambient light chamber having mounted therein a second elongated light source and a second elongated reflector, and having mounted on the top thereof a second elongated refractor plate; and said second reflector and said second refractor plate provide for directing the light from the second light source upwardly and outwardly to provide ambient light for the area.

8. A lighting arrangement for a work station in an open plan office, the combination comprising:

a pair of spaced upright side panels;

an upright rear panel interconnecting said side panels;

a horizontal work surface supported above the floor in the opening defined by said panels;

an elongated light fixture mounted across said side panels at a height above the eye height of a person seated adjacent the front edge of the work surface but not at a height substantially above the eye height of a person standing adjacent thereto;

said light fixture including an elongated light source having a horizontal axis, an elongated reflector, and an elongated refractor plate;

said light source disposed with its horizontal axis positioned substantially directly above the front edge of the work surface;

said refractor plate having its front edge disposed below said light source and extending rearwardly thereof, and having formed on one of the surfaces thereof linear prismatic elements oriented parallel to the horizontal axis of said light source; and said reflector providing for reflecting light from the light source downwardly and rearwardly over the surface of the refractor plate whereby said linear prismatic elements redirect the light rays and distribute them over the surface of the work surface such that they reflect therefrom in a direction away from a person seated adjacent the front edge of the work surface to view a task thereon.

9. A lighting arrangement for a work station in an open plan office as defined in claim 8 wherein hanger means are provided on either end of said light fixture for mounting it across the side panels of said work station.

* * * * *